US006281454B1

(12) United States Patent
Charles et al.

(10) Patent No.: US 6,281,454 B1
(45) **Date of Patent: *Aug. 28, 2001**

(54) SWITCHABLE LOAD COIL CASE

(75) Inventors: Joseph T. Charles, Inverness; Steven D. Evans, Algonquin; Steven P. Moehling, Crystal Lake; Ronald Washburn, Marshall; Eduardo Leon, Hanover Park; Walter Hardwood, Streamwood; Gerald A. Greco, Elk Grove, all of IL (US)

(73) Assignee: Charles Industries, Ltd., Rolling Meadows, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/337,137

(22) Filed: Jun. 21, 1999

(Under 37 CFR 1.47)

Related U.S. Application Data

(63) Continuation-in-part of application No. 08/753,797, filed on Nov. 29, 1996, now Pat. No. 5,292,402.

(51) Int. Cl.[7] ..... H01H 19/58; H01H 9/04

(52) U.S. Cl. ..... 200/11 R; 200/11 G; 200/302.1

(58) Field of Search ..... 200/11 R–11 TW, 200/1 V, 17 R, 18, 302.1–302.3; 178/46; 336/65; 323/340–356

(56) References Cited

U.S. PATENT DOCUMENTS

| | | | |
|---|---|---|---|
| 2,360,801 | 10/1944 | Steinmayer et al. | 200/302.1 |
| 3,255,319 | 6/1966 | Paine | 200/302.1 |
| 3,316,363 | 4/1967 | Valdettaro et al. | 200/302.1 |
| 3,470,333 | 9/1969 | Schneider et al. | 200/11 G |
| 3,855,521 | 12/1974 | Kiuchi | 200/11 G |
| 3,856,980 | 12/1974 | Moser et al. | 178/46 |
| 3,988,707 | 10/1976 | Moser et al. | 336/65 |
| 4,172,964 | 10/1979 | Reinebach | 178/46 |
| 4,260,853 | 4/1981 | Charles | 178/46 |
| 4,443,208 | 4/1984 | Noetzelmann, Sr. | 178/46 |
| 4,558,189 | 12/1985 | Dibbern, Jr. et al. | 200/1 V |
| 5,010,214 | 4/1991 | Yamazaki | 200/11 G |
| 5,929,402 * | 7/1999 | Charles et al. | 200/11 R |

OTHER PUBLICATIONS

Brochure of Coil Sales & Manufacturing Company, a Charles Industries company, on Load Coil "Highest Performance Load Coil for Uninterrupted Reliability"; Aug. –1996.

Brochure of Coil Sales & Manufacturing Company, a Charles Industries company, on Universal Case for Universal load coil cases; Jan. 1993.

* cited by examiner

*Primary Examiner*—J. R. Scott
(74) *Attorney, Agent, or Firm*—Leydig, Voit & Mayer, Ltd.

(57) ABSTRACT

A switchable load coil case is provided having a switch assembly connected to the load coil and incoming and outgoing wire pair. The switch assembly has an actuator movable between loaded and bypass positions wherein the switch assembly connects the load coil in series with the incoming and outgoing wire pair when the actuator is in the loaded position and connects the incoming and outgoing wire pair while bypassing the load coil when the actuator is in the bypass position.

19 Claims, 12 Drawing Sheets

26
30
10
32
24
28
18
14
16
34
33
12
22
25

SWITCHABLE LOAD COIL CASE

CROSS REFERENCE TO RELATED APPLICATIONS

This application is a continuation-in-part of application Ser. No. 08/753,797, filed Nov. 29, 1996, for a Switchable Load Coil Case, now U.S. Pat. No. 5,292,402.

FIELD OF THE INVENTION

The present invention relates generally to a load coil case for terminating loads and, more particularly, to a switchable load coil case.

BACKGROUND OF THE INVENTION

In data and voice transmission lines typically used in the telephone industry, the cable consists of a plurality of wire pairs, typically segregated into groups of 50, 100, 200, 400, 600, 1200 or 1800 pairs, which are covered by a pressurized and airtight metallic sheath and a plastic outer protective sheath. Wire pairs extending between a central source and a subscriber have substantial capacitance, resulting in a change in impedance with length. The capacitance effect of the cable conductors has a direct relation on the voice band (300 Hz to 3000 Hz) from any given point—the higher the frequency, the greater the loss or attenuation. Thus, it is conventional to connect inductance or load coils in the conductors to maintain a predetermined impedance to balance and improve the voice frequency characteristics of the cable conductors and to assure maximum signal power transfer between the central source and the subscriber. The load coils are typically connected to wire pairs at predetermined intervals so that the known capacitance of the resulting predetermined wire pairs will be balanced by the inductance of the load coil.

Load coil cases are typically used for housing the plurality of load coils associated with each of the 50, 100, 200, 400, 600, 1200 or 1800 wire pairs. After the individual wire pairs are connected to a corresponding load coil, they are typically assembled in a compact configuration in the load coil case and the load coil case is filled with an appropriate encapsulating or potting compound to keep moisture from affecting the load coils, such as by oxidizing the metallic inductor cores, damaging the insulation of the wires in the load coil, or forming conductive paths between wire pairs which would result in degraded compensation and cross linking and cross talk between wire pairs The load coil may then be stored in pedestal cabinets, in underground manholes, and the like.

In many applications, however, when the subscriber wants high frequency service, each and every load coil located between the source and subscriber must be "unloaded" or bypassed from the wire pair servicing the particular subscriber. In order to bypass the load coil, each load coil case must first be located in the dirt, water, and other debris typically found in the outside plant telephone environment. After the outer and metallic sheaths are removed and the specific wire pair servicing the subscriber is located from the potentially hundreds of wire pairs typically found in telecommunications cables, the load coil is unloaded or bypassed by splicing the wire pair around the load coil. The cable must be recovered with the metallic and plastic sheaths, pressurized and tested for leaks It will be appreciated that a subscriber may alternatively require that a disconnected load coil be reloaded or re-connected to the wire pair in a similar manner. In either case, it may typically take two technicians eight hours or more to complete the splicing operation for each load coil in the subscriber's wire pair.

SUMMARY AND OBJECTS OF THE INVENTION

Accordingly, it is an object of the present invention to provide a novel load coil case which permits a load coil to be easily and selectively loaded into the circuit and unloaded or bypassed from the circuit.

A related object of the present invention is to provide a load coil case having a switch assembly which may be adapted to accommodate any number of wire pairs and load coils.

A further object of the present invention is to provide a switch assembly which may be easily and quickly assembled. A related object is to provide a switch assembly to which a load coil and wire pairs may be easily and quickly assembled.

It is another object of the present invention to provide a novel actuator which permits contacts to be electrically separated in a small package.

Yet another object of the present invention is to provide a switchable load coil case which is adapted for use in hostile environments such as, for example, underground, under water or other wet conditions.

These and other features and advantages of the invention will be more readily apparent upon reading the following description of a preferred exemplified embodiment of the invention and upon reference to the accompanying drawings.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

This is a continuation-in-part of U.S. patent application Ser. No. 753,797, filed Nov. 29, 1996, which discloses an embodiment of a switchable load coil case and is incorporated herein by reference in its entirety.

Figure 1:
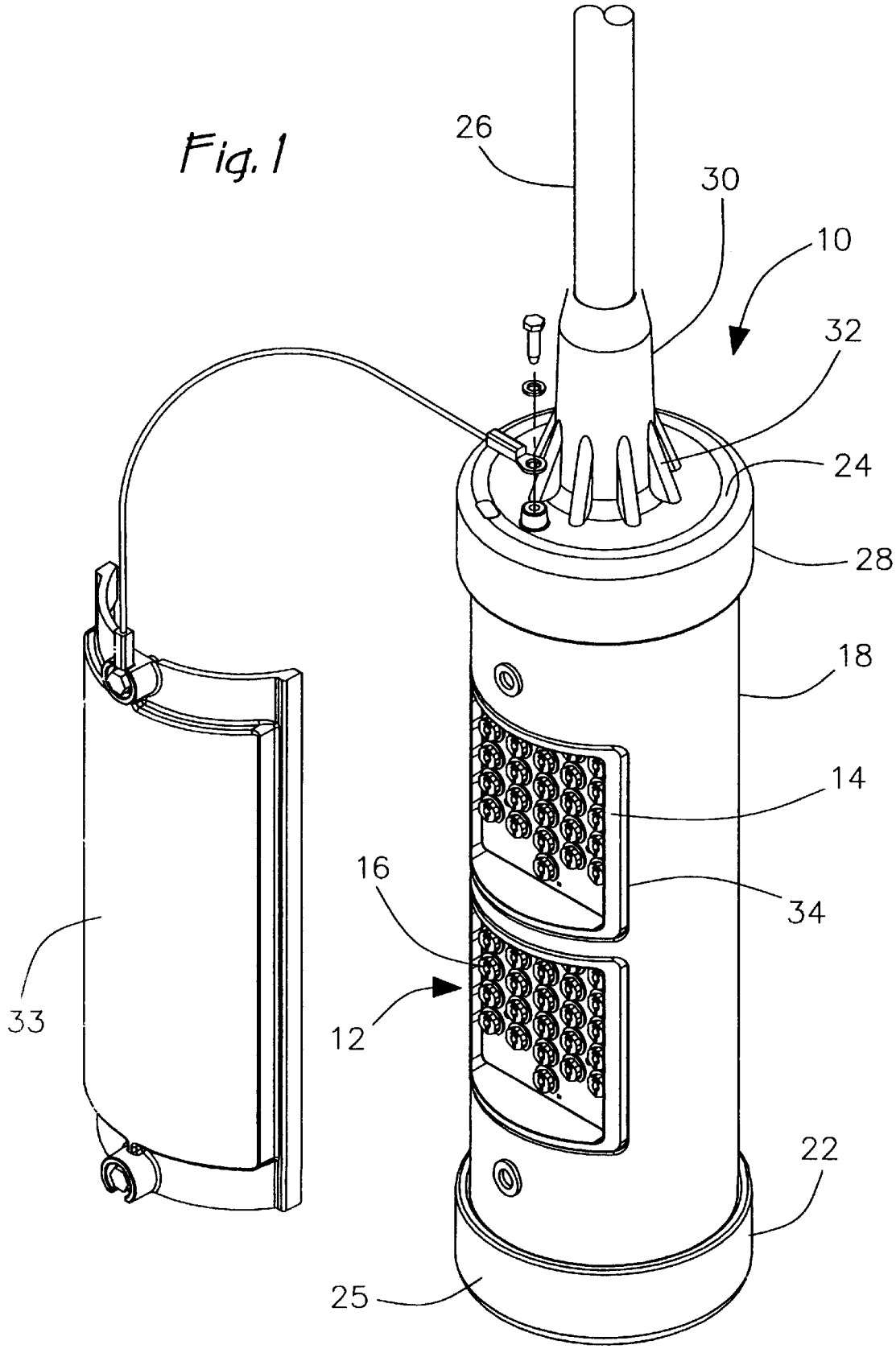
FIG. 1 is a perspective view of a switchable load coil case including its cover plate in accordance with the present invention.
Figure 2:
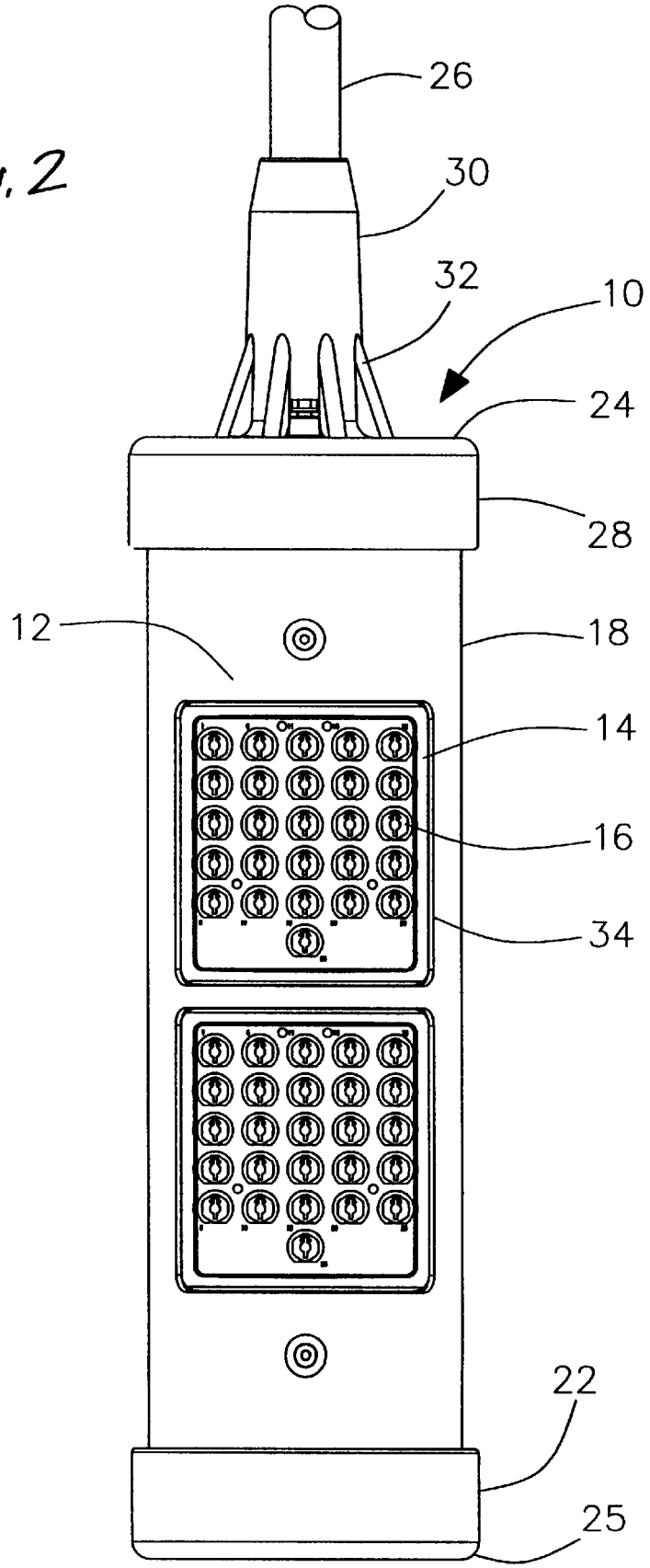
FIG. 2 is an elevational view of the switchable load coil case in FIG. 1.

Turning to the figures, FIGS. 1–2 illustrate another embodiment of a switchable load coil case 10 in accordance with the present invention incorporating two switch assemblies 14. The switchable load coil case 10 includes a generally cylindrical housing 18 formed of a suitable material such as, for example, polyethylene, polyvinyl chloride plastic, and the like, for providing protection against adverse weather conditions, water infiltration, corrosive environments and the like. One end of the housing 18 is closed with a generally circular end cap 25 having a depending skirt 22 dimensioned for air and water-tight sealing engagement with the end of the housing 18. The other end of the housing 18 has a generally cylindrical cable entrance cap 24 for receiving the stub end of a communication cable 26. The entrance cap 24 has a skirt 28 dimensioned for air and water-tight sealing engagement with the housing 18, a strain relief neck 30, and a plurality of reinforcing ribs 32.

As is conventional, the communication cable 26 has a plurality of incoming electrical leads or conductor pairs (generally designated 100 and 102 in FIG. 9) and outgoing wire pairs (generally designated 104 and 106 in FIG. 9) surrounded by a protective metallic sheath (not shown) and encased within an outer protective plastic sheath (not shown). The entrance cap 24 is dimensioned for air and water-tight sealing engagement with the outer plastic sheath of the cable 26. A plurality of conventional load coils (generally designated 107 in FIG. 9) corresponding to each wire pair is located in the load coil case 10 wherein each load coil 107 has a pair of incoming leads generally designated 108 (or Tin-coil) and 110 (or Rin-coil) and a pair of outgoing leads generally designated 112 (or Tout-coil) and 114 (or Rout-coil). Although any type of conventional load coil may be used, a bifilar wound 66 or 88 mH coil has been found to be suitable.

In accordance with certain objects of the invention, at least one switch assembly or block 14 is provided for selectively loading or bypassing the load coil 107 associated with each wire pair. The switch assembly 14 comprises at least one rotary actuator or switch 16. In the embodiment illustrated in FIGS. 1–2, the load coil case 10 has two switch assemblies 14 disposed in corresponding housing apertures generally designated 34. Each load coil case 10 has a cover plate 33 (shown in FIG. 1) which may be releasably attached using a pair of screws 13, bolts or the like that cooperate with corresponding holes 15 located on the housing 18. The cover plate 33 covers and protects the switching assembly 14 from dirt and impact damage and the like. A lanyard 31 is attached to the cover plate 33 by one of the screws 13, bolts or the like and to the entrance cap 24 by a self-tapping bolt 23 or the like which is fitted through a washer 27 and into a corresponding hole 29 of a nozzle 37 disposed on top of the entrance cap 24.

The switchable load coil case 10 may be adapted to receive an appropriate number of switching assemblies 14 to accommodate a predetermined number of wire pairs such as, for example, the 50, 100, 200, 400, 600, 1200, 1800 wire pairs, typically used in the telephone industry. The illustrated switchable load coil case 10 has, for example, two switching assemblies 14 for accommodating 50 load coils.

Figure 3:
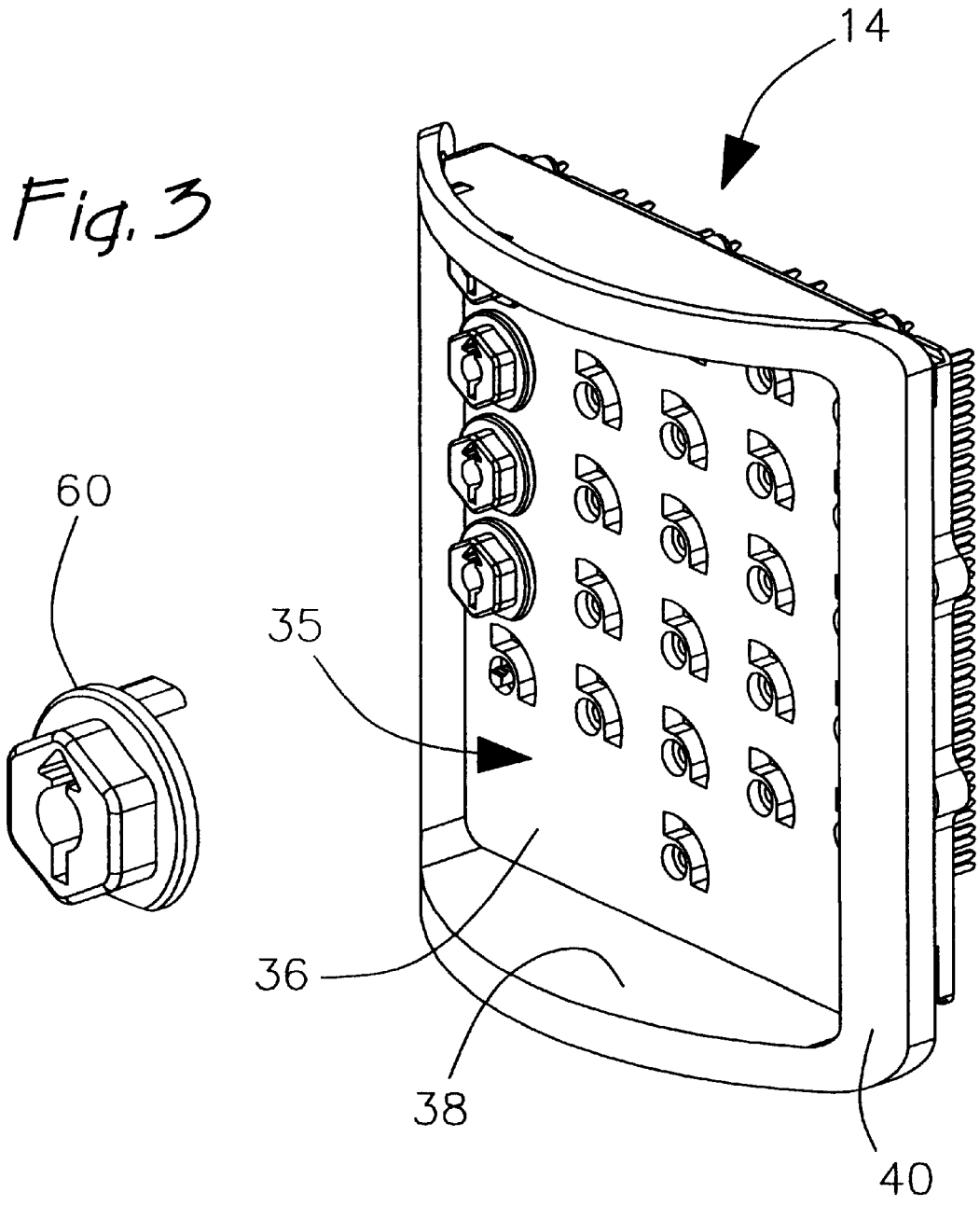
FIG. 3 is a front perspective view of a switching block shown in FIG. 1.
Figure 4:
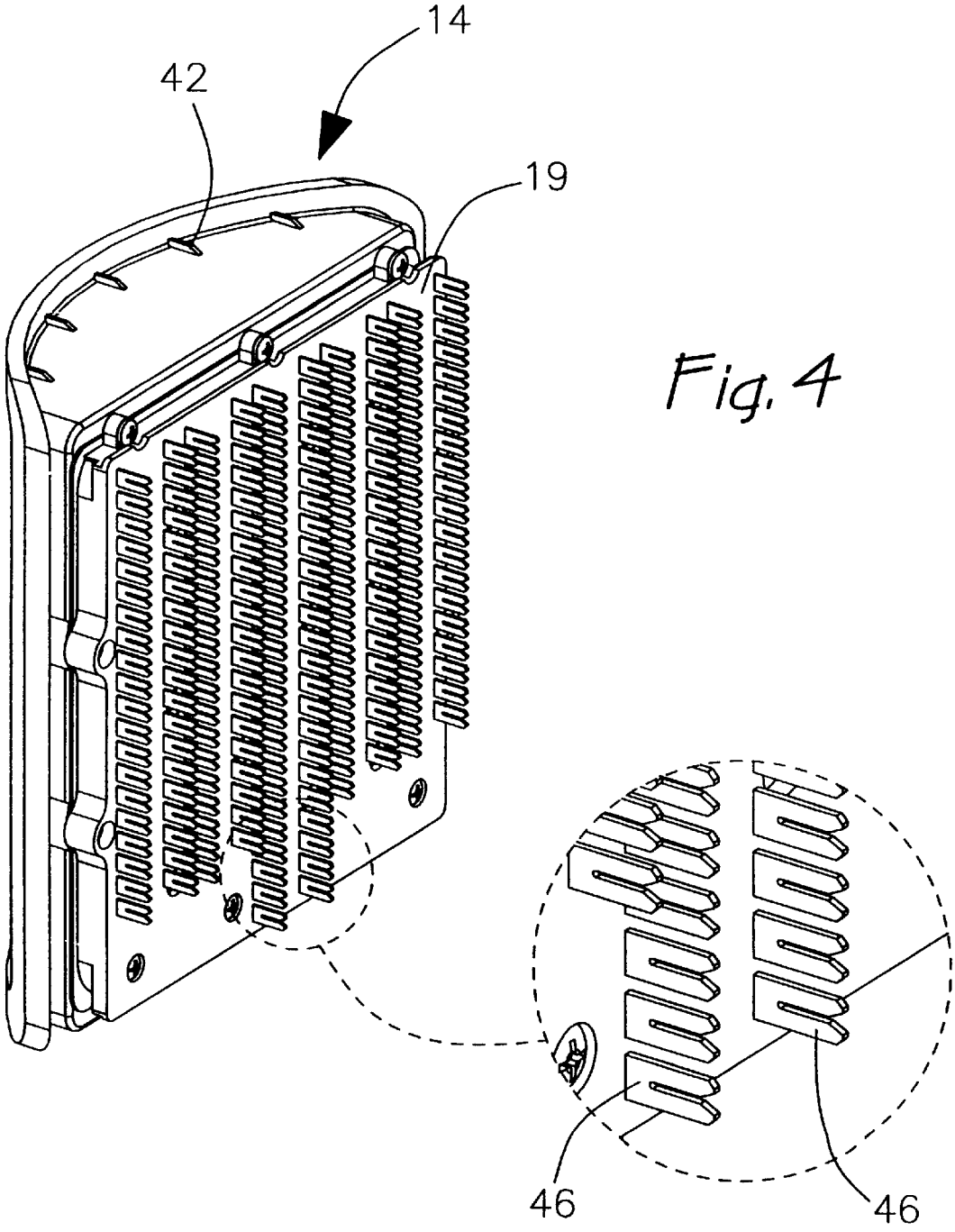
FIG. 4 is a rear perspective view of the switching block in FIG. 1.

Referring to FIGS. 1–4, the switching assembly 14 has an outwardly projecting shoulder 40 for limiting insertion of the switching assembly 14 into the housing 18. As best shown in FIG. 4, the switching assembly 14 may also have a plurality of engagement members 42 which deform when the switching assembly 14 is pushed into the housing aperture 34, thereby creating a friction fit between the switching assembly 14 and the housing 10 (FIGS. 1–2). The members 42 hold the switching assembly 14 in the housing aperture 34 until a thermo-plastic weld or other conventional air and water-tight seal can be formed between the shoulder 40 and the peripheral edge of the aperture 34 for eliminating air, dirt and contaminant infiltration into the load coil case 10. The illustrated embodiment of the switching assembly 14 has a rectangular configuration but may have any other configurations and dimensions adapted for sealably engaging the aperture 34.

As shown in FIGS. 3–4, 12–15, the switching assembly 14 has a front panel 11 and a back panel 19. In the illustrated embodiment the panels 11 and 19 are rectangularly shaped, but other shapes are possible. As best shown in FIG. 3, the front panel 11 has a recess 35 defined by a base 36 and four side walls 38. The back panel 19 has a base 20 which has at least one terminal 15 for receiving a contact assembly 21 of at least one actuator 16. Each terminal 15 is connected to one of the incoming and outgoing wire pairs and a corresponding load coil 107 (shown in FIG. 9). The back panel 19 may have any number of terminals 15, but the back panel 19 illustrated in FIG. 12 preferably has at least twenty-five (25) terminals 15 and a spare terminal 15*a* for use in the event one of the other 25 terminals are damaged during manufacture or assembly. Although the back panel 19 and the terminals 15 may be separately manufactured and assembled together, for example, by injection overmolding, they are preferably integrally molded from suitable materials such as thermoplastic.

Figure 5:
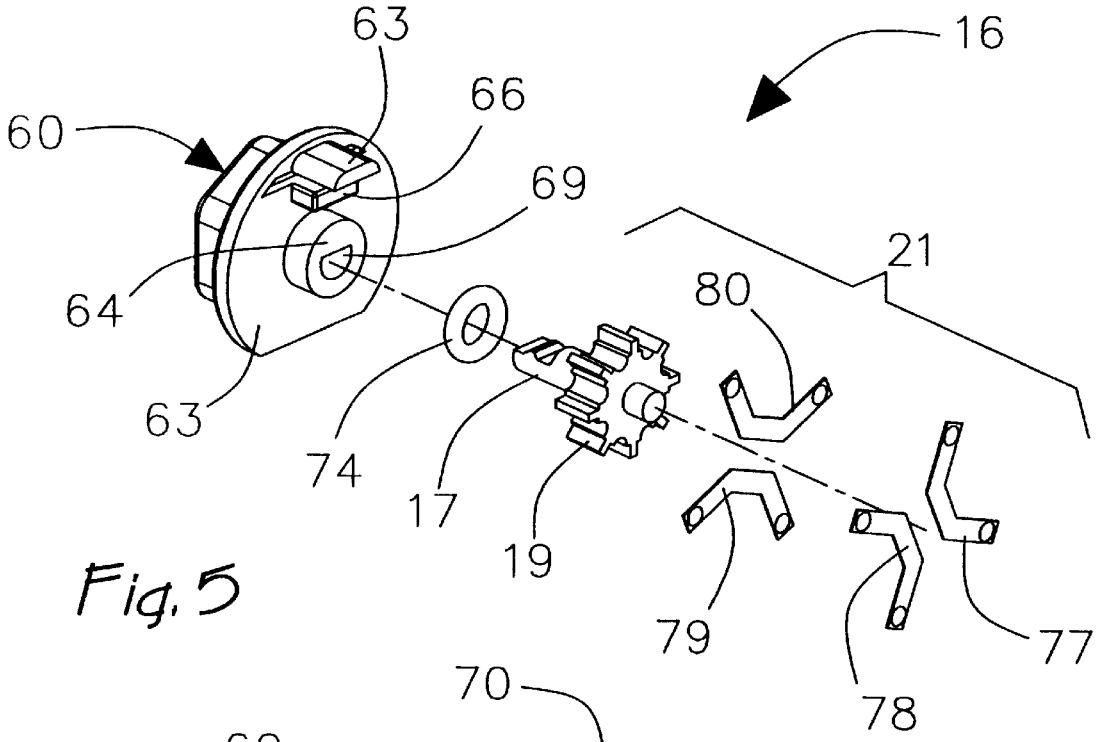
FIG. 5 is an exploded view of a rotary actuator or switch.
Figure 16:
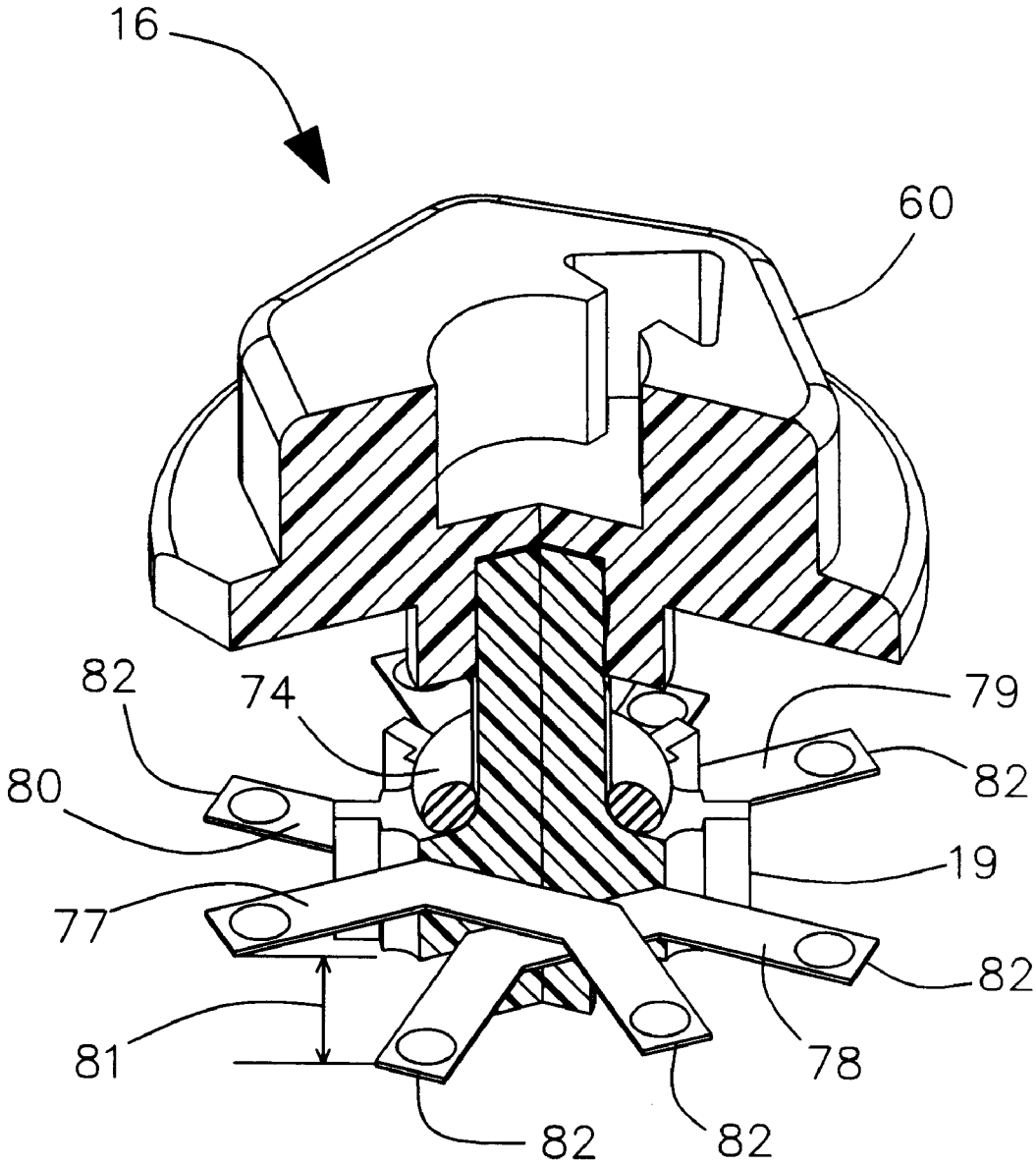
FIG. 16 is a partial cutaway view of an actuator.

For ease of reference, a single representative actuator 16 is shown in FIG. 5. It will be seen that the actuator 16 has a head 60 and a contact assembly 21. The head 60 has an outwardly protruding shoulder 63 which further has a tab 66, a detent 67, and a raised shoulder 64 which defines a cavity 69 adapted to receive a shaft 17 of the contact assembly 21. The cavity 69 is shaped to insure the proper orientation of the contact assembly during operation. The contact assembly 21 has a substantially non-conductive rotor 19 disposed circumferentially around the shaft 17, an O-ring 74, and a plurality of switch contacts 77–80. The O-ring 74 fits around the shaft 17 and creates an air-tight seal between the rotor 19 and the front panel base 36. As will be described in further detail, a protrusion 56 on the shaft 17 is adapted to engage a notch inside the cavity 69 in order to mate the head 60 of the actuator with the contact assembly 21. As best shown in FIG. 16, the switch contacts 77–80 are preferably insert molded into the rotor 19 with a distance 81 between adjacent contacts to prevent electricity from flowing from one switch contact to another. The arms 82 of each switch contact are arranged between a plurality flanges 63 on the rotor 19.

Figure 6:
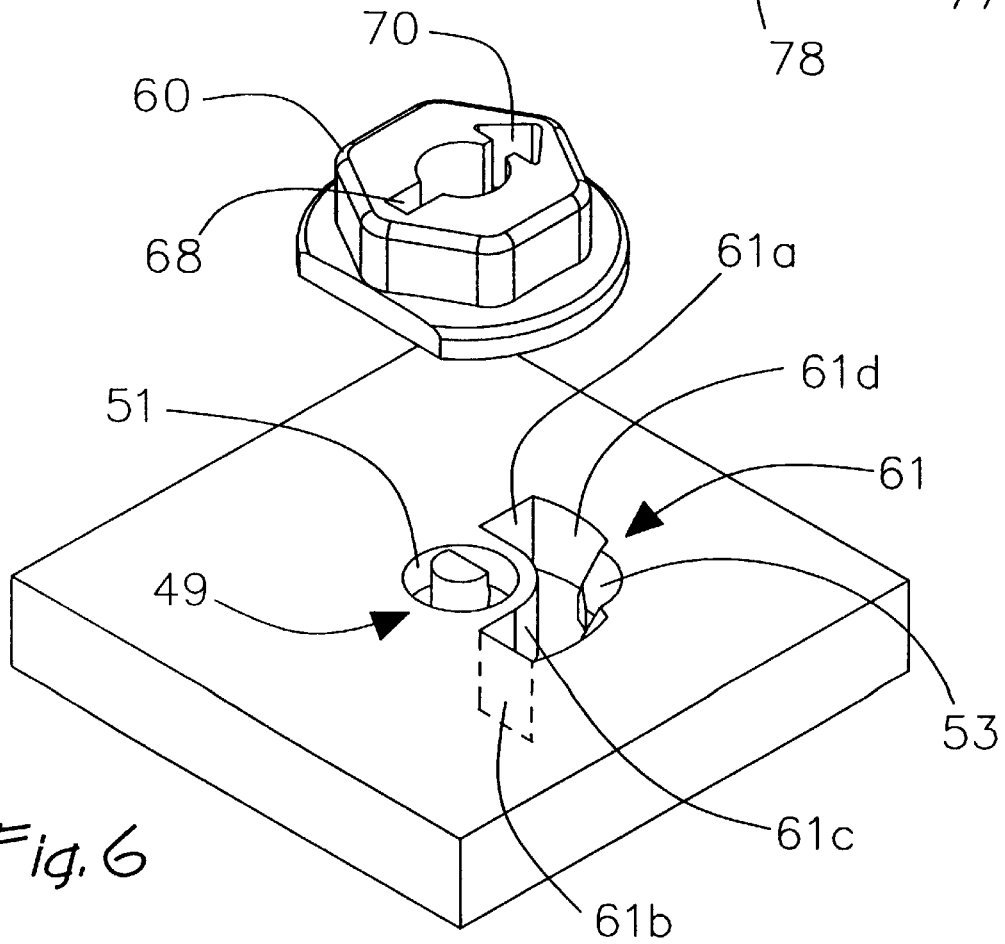
FIG. 6 is a view of the head of an actuator as it fits into the switching block.
Figure 7:
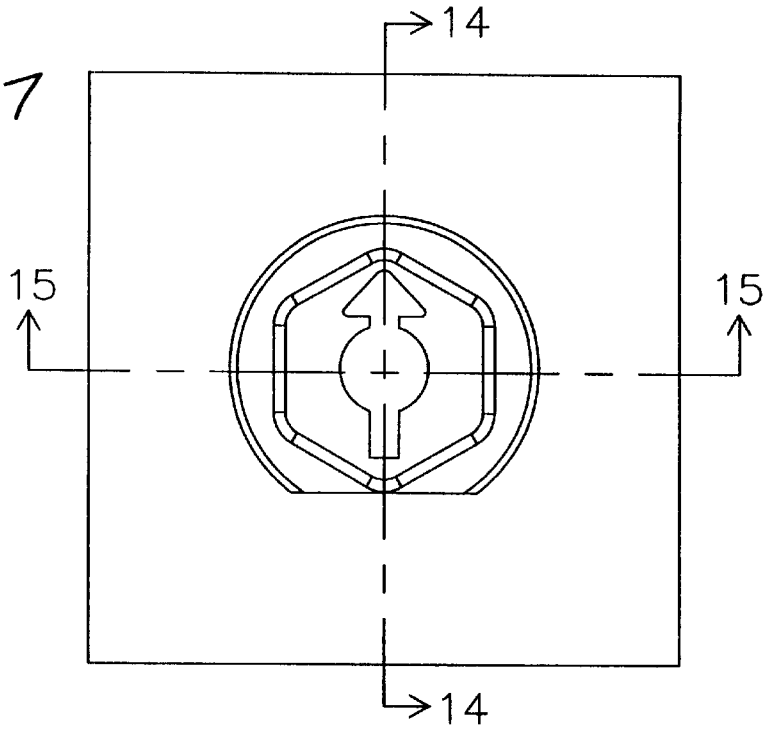
FIG. 7 is a top view of the actuator in the switching block.
Figure 8:
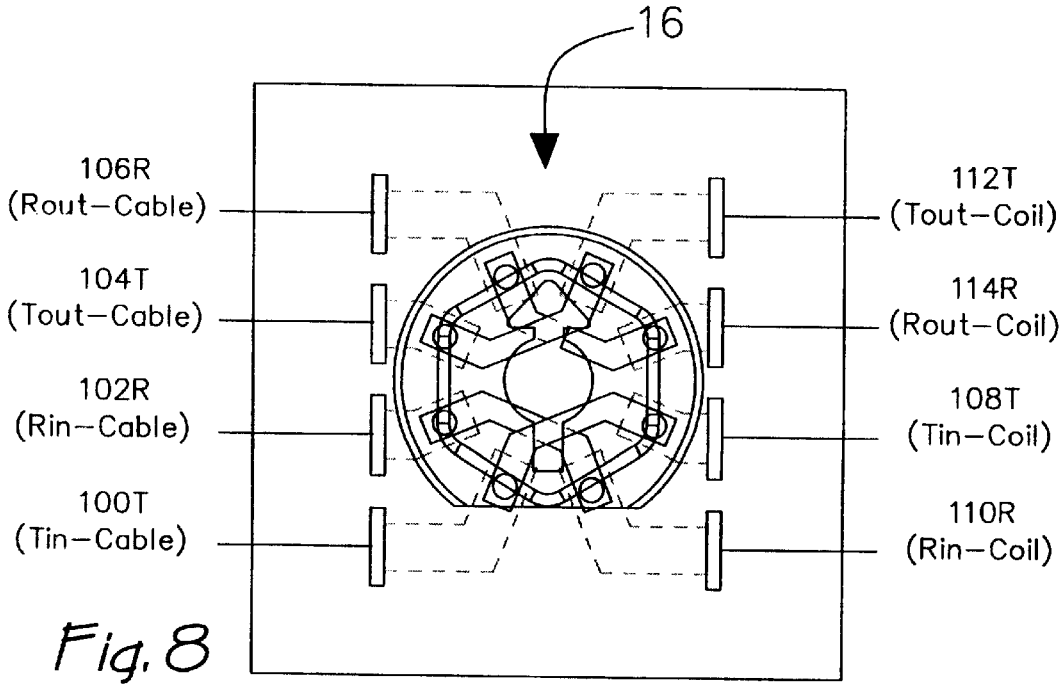
FIG. 8 is a schematic representation of FIG. 7 showing the terminal and actuator contact orientation.
Figure 15:
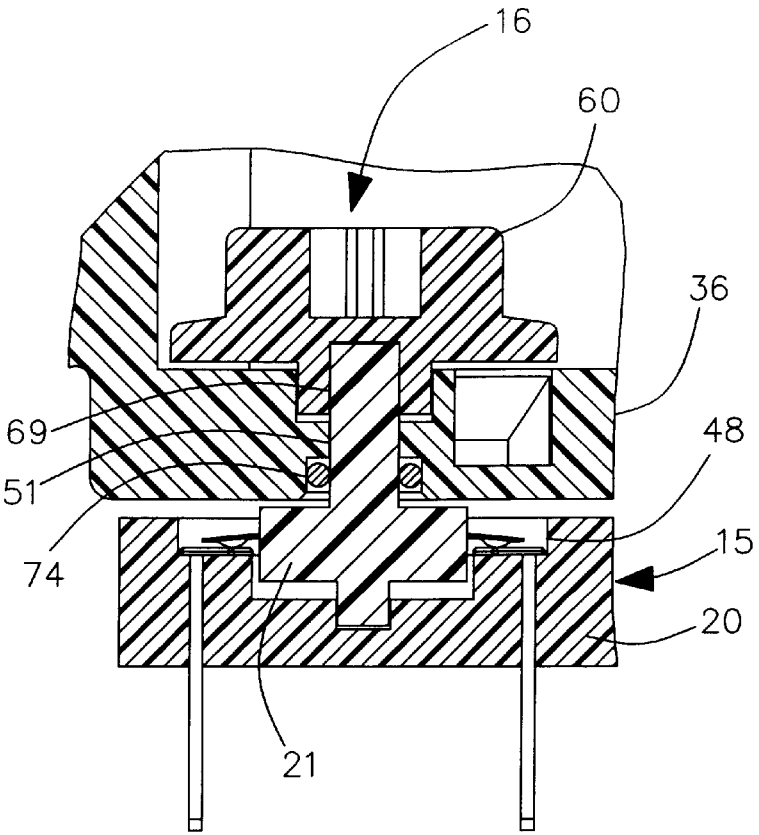
FIGS. 14–15 are sectional views taken along lines 14—14 and 15—15 in FIG. 7, respectively.
Figure 14:
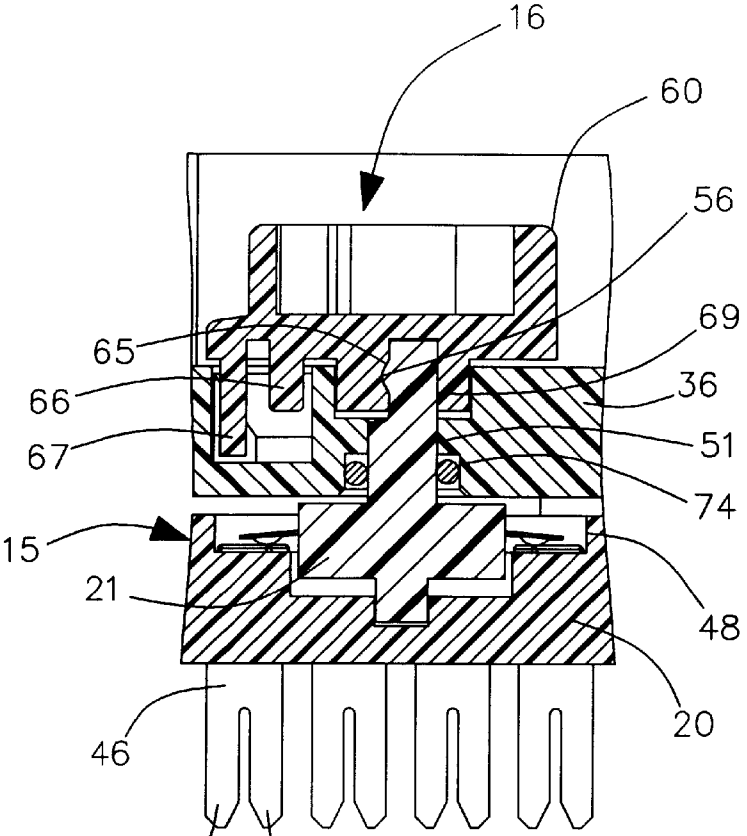

Referring to FIGS. 5–6 and 14–15, the front panel base 36 has at least one hole 49 defined by a circular wall 51 for receiving the head 60 on one side and the shaft 17 of the contact assembly 21 on the other side. As best shown in FIGS. 14–15, means for locking the head 60 onto the shaft 17 comprises at least one protrusion 56 adapted for resiliently deflecting in response to the insertion of the shaft 17 into the cavity 69 and subsequently engaging a notch 65. As best shown in FIG. 6, at least one groove 61 having a first stopwall 61*a* and a second stopwall 61*b* is provided in the front panel base 36 adjacent to each hole 49. The groove 61 provides a path for the tab 66, while the stopwalls 61*a* and 61*b* act as a barrier to the tab 66, thereby limiting the rotation of the actuator 16. The groove 61 also has a ridge 53 for cooperatively engaging the detent 67 to provide an intermediate stopping position for the actuator 16 in order to indicate to the user that the actuator 16 is turning properly during operation.

Referring to FIGS. 14–15, it will be seen that each terminal 15 has a cavity 48 for receiving the contact assembly 21 of an actuator 16. Furthermore, each terminal 15 has eight IDC contacts 46 that are insert molded in the base 20 of the back panel 19. It will be seen that the IDC contacts 46 pass through the back panel base 20 into the terminal cavity 48 for electrical connection with the switch contacts 77–80 of the actuator 16. In order to minimize or eliminate shorting between the switch contacts 77–80 and the IDC contacts 46 during surges and the like, non-conductive or dielectric grease may also be inserted into the cavity 48 prior to insertion of the contact assembly 21 into the cavity 48 of the terminal 15. As best shown in FIG. 14, each IDC contact 46 has two opposing arms 46*a* which are spaced apart to receive a lead (not shown) wherein the arms 46*a* cut through the lead's insulation to electrically connect to the interior lead. Although any suitable IDC contact may be used, the IDC contacts preferably are capable of terminating 24–30 gauge wire.

Referring to FIGS. 6 and 14–15, the groove 61 permits selective rotation of the actuator 16 between a loaded position, in which the tab 66 of the actuator head 60 abuts the first stopwall 61*a,* and an unloaded position, in which the tab 66 abuts the second stopwall 61*b.* Additionally, an intermediate position, in which the detent 67 resiliently deflects to lockingly engage the ridge 53, is provided. In the loaded position, the terminal 15 connects the load coil 107 (shown in FIG. 9) with the incoming and outgoing wire pairs. In the unloaded or bypass position, the terminal 15 and actuator 16 bypasses the load coil 107, thereby "unloading" the load coil 107 and connecting the incoming and outgoing wire pairs. The switch head 60 preferably has a screwdriver slot 68 and/or hex head for assisting rotation of the actuator 16 between the loaded and bypass positions. It is also preferable that the actuator head 60 have an arrow generally designated as 70 or other reference for indicating the loaded and unloaded positions. In the illustrated embodiment, the arrow 70 is aligned with the tab 66 and the detent 67, although other configurations are possible.

Figure 9:
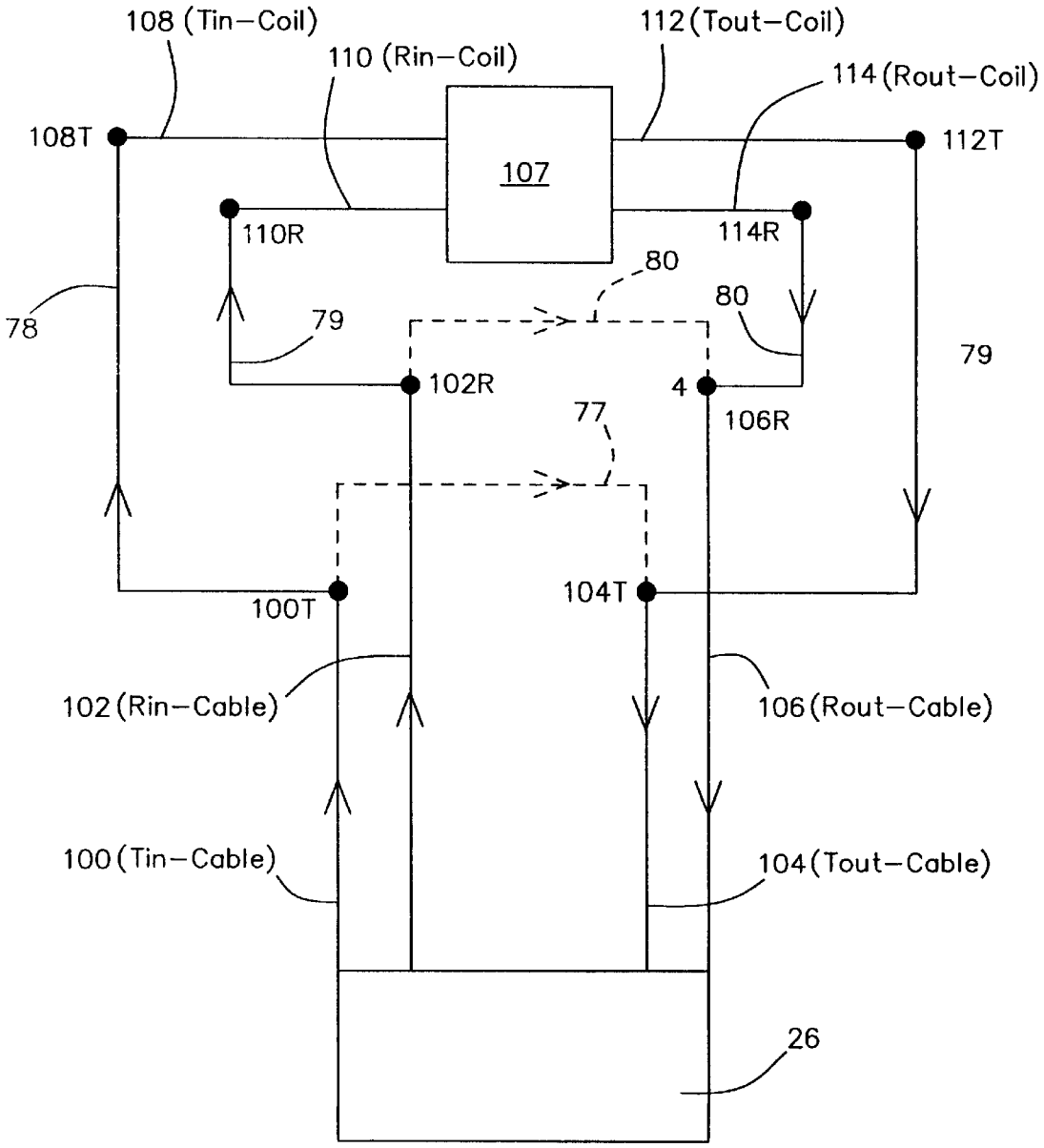
FIG. 9 is a switching diagram of the flow of current through the contact assembly and the terminal, with the bypass or unloaded mode shown in broken lines and the loaded mode shown in solid lines.

FIG. 9 illustrates a switching schematic diagram of each terminal 15. Each terminal 15 has a corresponding incoming wire pair designated 100 (or Tin-cable) and 102 (or Rin-cable) and an outgoing wire pair 104 (or Tout-cable) and 106 (or Rout-cable) from the cable stub 26. Each terminal 15 has a corresponding load coil 107 having an incoming wire pair designated 108 (or Tin-coil) and 110 (or Rin-coil) and an outgoing wire pair designated 112 (or Tout-coil) and 114 (Rout-coil). In FIG. 9, each lead 100, 102, 104, 106, 108, 110, 112, 114 has a respective contact 100T, 102R, 104T, 106R, 108T, 110R, 112T, and 114R generally representing the electrical connection to one of the eight terminal contacts 46 on the rear of the switching block 14. And, as previously discussed, each actuator 16 has actuator contacts 77, 78, 79, 80. In accordance with certain objects of the invention, the switch assembly 12 selectively permits the incoming wire pair 100, 102 to: (1) be connected in series with the load coil 107 when the actuator 16 is in the loaded position as shown in solid lines in FIG. 9 or (2) bypass the load coil and be connected in series with the outgoing wire pair 104, 106 when the switch is in the bypass position as shown in broken lines in FIG. 9.

Figure 10:
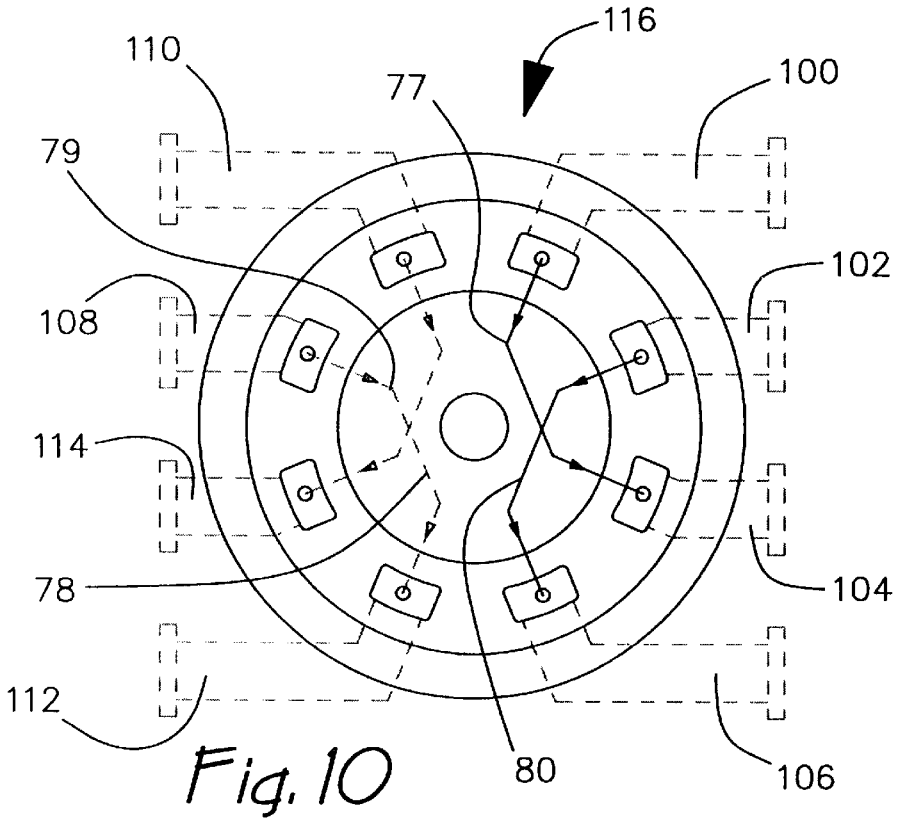
FIG. 10 is a schematic diagram of the actuator in the bypass position showing the current path in solid lines.
Figure 11:
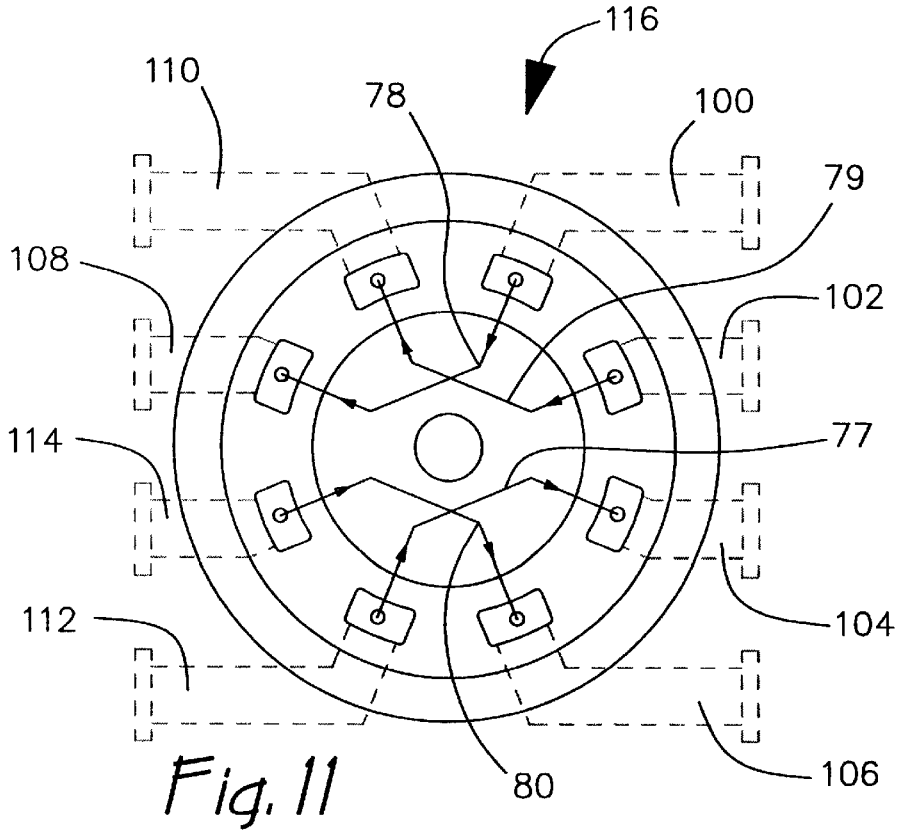
FIG. 11 is a schematic diagram of the actuator in the loaded position showing the current path in solid lines.
Figure 12:
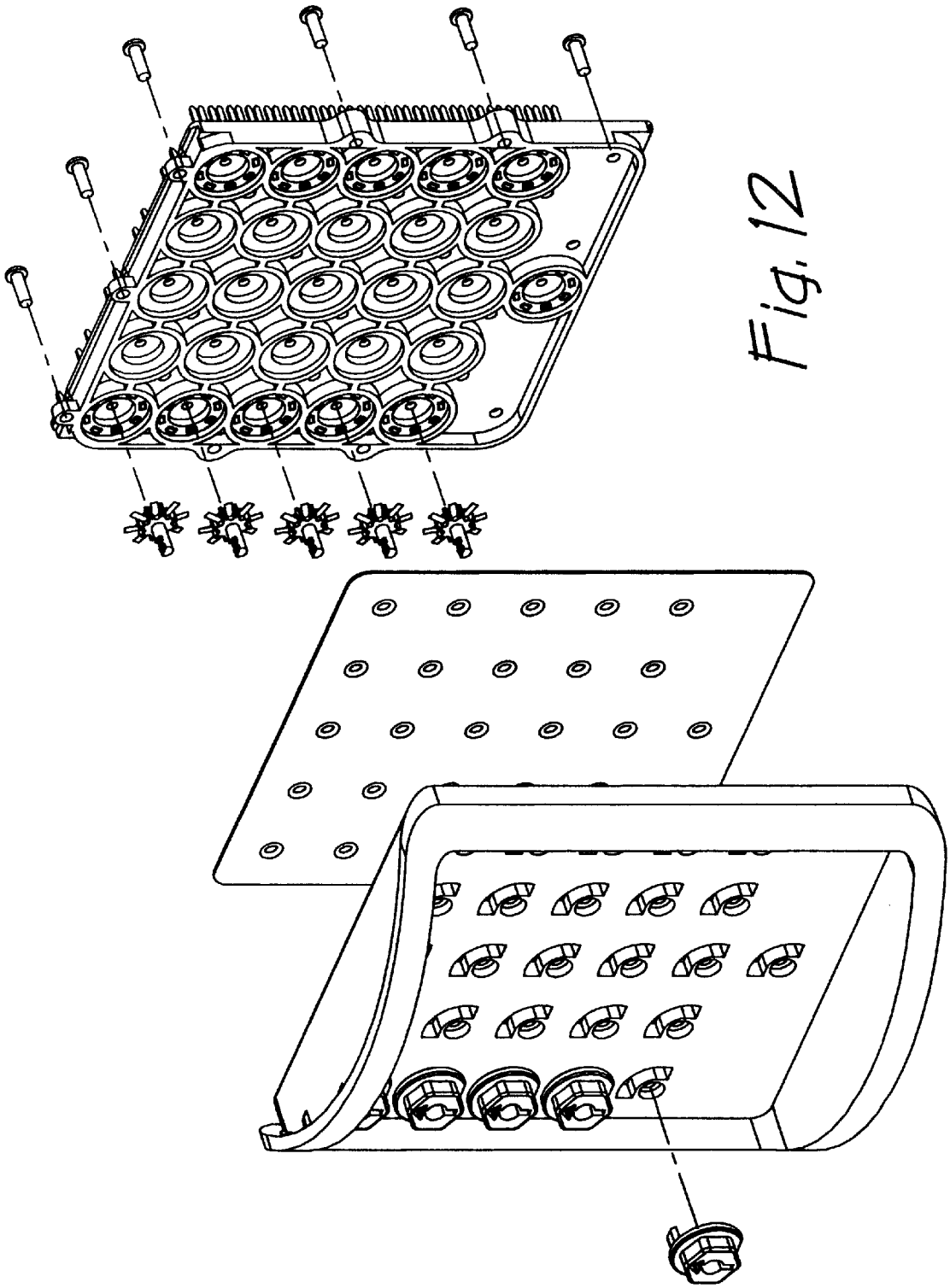
FIG. 12 is an exploded view from the front of the switching block shown in FIG. 1.
Figure 13:
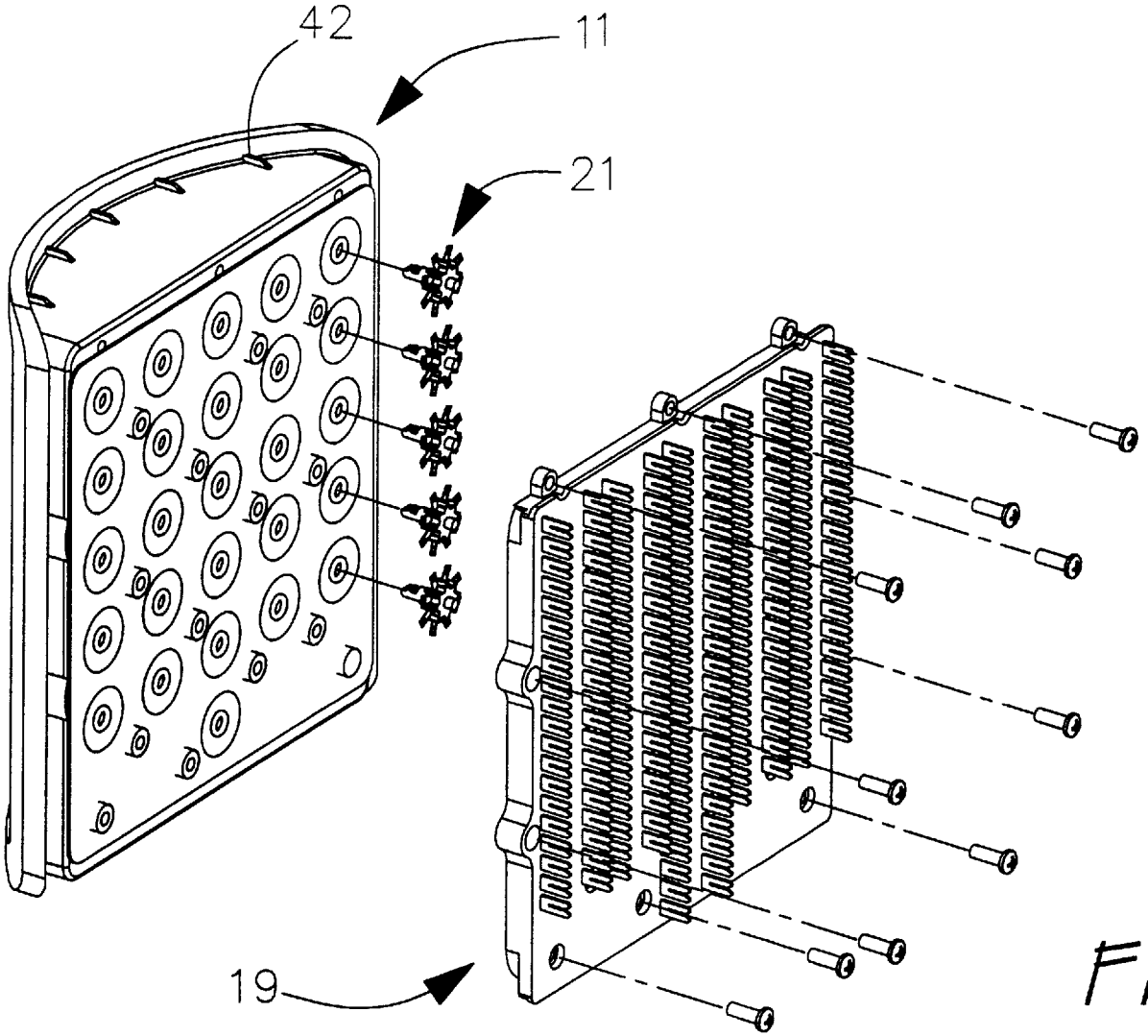
FIG. 13 is an exploded view from the rear of the switching block shown in FIG. 1.

FIGS. 10–11 are schematic diagrams showing the current path (in solid lines) in a representative terminal 15 and actuator 16 of the switch assembly 12 when the rotary actuator 16 is in the bypass position (FIG. 10) and the loaded position (FIG. 11). The schematic representation of the rotary actuator is generally designated 116 and has four switch contacts 77, 78, 79, 80, each switch contact having two points of contact. The eight contacts 100T, 102R, 104T, 106R, 108T, 110R, 112T, and 114R schematically represent the terminal contacts 46.

When the switch 116 is in the bypass position as shown in FIG. 10, the switch contacts 77 and 80 connect the incoming wire pairs 100 (Tin-cable), 102 (Rin-cable) with the outgoing wire pairs 104 (Tout-cable), 106 Rout-cable), respectively, permitting current carried by the incoming wire pairs 100, 102 to bypass the load coil 107. Referring to FIGS. 9 and 11, current flows through cable 100 (Tin-cable), contact 77, and cable 104 (Tout-cable). Similarly, current flows through cable 102 (Rin-cable), contact 80, and cable 104 (Rout-cable). Thus, the subscriber receives the desired high frequency signal unmodified by the load coil 107. It will be appreciated that, when the actuator 116 is in the bypass position, current passes through contacts 77, 80 (shown in solid lines) but not contacts 78, 79 (shown in broken lines).

When the switch 116 is rotated a quarter turn from the bypass position to the loaded position as shown in FIG. 1, the switch 116 connects the load coil 107 in series with the incoming wire pairs 100, 102 and the outgoing wire pairs 104, 106. Referring to FIGS. 9 and 11, current flows through cable 100 (Tin-cable), contact 78, coil lead 108 (Tin-coil ), load coil 107, coil lead 112 (Tout-coil), contact 77, and cable 104 (Tout-cable). Similarly, current flows through cable 102 (Rin-cable), contact 79, coil lead 108 (Rin-coil), load coil 107, coil lead 114 Rout-coil), contact 80, and cable 106 (Rout-cable). It should now be appreciated that, in accordance with the objects of the invention, the switch connects the incoming and outgoing wire cable pairs 100, 102, 104, 106 to the load coil leads 108, 110, 112, 114. In conventional load coil cases, however, the cable leads 100, 102, 104, 106 are typically connected directly to the load coil leads 108, 110, 112, 114, respectively, so that the incoming and outgoing wire pairs 100, 102, 104 and 106 must be physically cut from the load coil 107 and spliced together to bypass the load coil 107. In contrast, the switch assembly 12 of the present invention permits the load coil to be bypassed merely by rotating the actuator 16 to the unloaded or bypass position, thereby saving substantial time and expense.

To assemble the switching assembly 14, each contact assembly 21 is placed in the cavity 48 of its corresponding terminal 15 as shown in FIGS. 12–15. The cavity 48 is filled with a non-conductive grease to minimize or eliminate shorting between the switch and terminal contacts. Each shaft 17 is then fitted through an O-ring 74, preferably by placing a template 22 (shown in FIG. 12), which holds the O-rings for the switching block 14, over the shafts 17. The front panel 11 is then positioned so that each of the shafts 17 passes through its corresponding hole 49. Each head 60 may then be locked onto its respective shaft 17 by engaging the respective protrusion 56 with the groove 65. The template 22 and the contact assemblies 21 may then be sandwiched between the front and back panels and secured by a plurality of screws 39 that pass through corresponding holes 43 in the back panel 19 and are fastened into corresponding holes 41 of the front panel 11. In this manner, a watertight seal from front to back is formed on the switching assembly 14.

In order to assemble the switchable load coil case 10, the required number of switch assemblies 14 are attached to the load coil case 10. In the illustrated embodiment, the load coil case has two switching blocks comprising 50 terminals 15 (and three spare terminals 15*a*). The IDC contacts 46 are insert molded to the back panel base 20. The individual wire leads 110, 112, 114, and 116 from the load coil 107, incoming wire pairs 100, 102 and outgoing wire pairs 104, 106, generally located within the housing 18, are terminated at their respective IDC contacts as schematically shown in FIGS. 10–11. The IDC contacts project through the base into the terminal cavity 48 for subsequent electrical engagement with the switch contacts 77–80. The switching assembly 14 is inserted into the case aperture 34 and bonded to the peripheral edge of the aperture 34 to provide a water-tight seal. The cover plate 33 may also be attached to the case 10 to protect the terminals 15 located within the recess 35. The case 10 is then potted to protect the load coils 107 and IDC connections from damage. The outgoing wire pairs 106, 108 protruding from the cable stub 26 are available for subsequent connection to a main cable or a subscriber.

Thus it will be seen that a novel and improved switchable load coil case has been provided which attains the aforementioned objects. Various additional modifications of the embodiments specifically illustrated and described herein will be apparent to those skilled in the art, particularly in light of the teachings of this invention. The invention should not be construed as limited to the specific form shown and described, but instead is set forth in the following claims.

What is claimed is:

1. A switchable load coil case comprising: a housing for covering a load coil; the housing having an opening for receiving front and back panels; the load coil associated with an incoming and outgoing wire pair; an actuator movable between loaded and bypass positions comprising a head and a contact assembly connected to the load coil and incoming and outgoing wire pairs, wherein the contact assembly connects the load coil in series with the incoming and outgoing wire pairs when the actuator is in the loaded position and connects the incoming and outgoing wire pairs while bypassing the load coil when the actuator is in the bypass position; and wherein the contact assembly of the actuator is disposed between the front panel and the back panel and communicates with the head of the actuator through the front panel.

2. The switchable load coil case as set forth in claim 1 wherein the back panel has a terminal housing which communicates with the actuator, and the terminal housing has a plurality of contacts for selectively connecting the incoming and outgoing wire pairs and a plurality of leads from the load coil with a plurality of contacts on the actuator.

3. The switchable load coil case as set forth in claim 2 wherein the terminal housing comprises a cavity for rotatably receiving the actuator between the loaded and bypass positions, and wherein the actuator has a protrusion for cooperatively engaging a groove having first and second stopwalls which limit movement of the actuator between the first and second stopwalls, and wherein engagement between the first stopwall and the protrusion locates the actuator in the bypass position and engagement between the second stopwall and the protrusion locates the actuator in the loaded position.

4. The switchable load coil case as set forth in claim 3 wherein the actuator head comprises a shoulder having an internal notch, and the contact assembly comprises a shaft for engaging the internal notch and for connecting the actuator head with the contact assembly.

5. The switchable load coil case as set forth in claim 3 wherein the groove further comprises a ridge disposed between first and second stopwalls, and the actuator comprises at least one detent which resiliently deflects to lockingly engage a first side of the ridge to position the actuator in the bypass position and a second side of the ridge to position the actuator in the loaded position.

6. The switchable load coil case as set forth in claim 2 comprising means for rotatably locking the actuator between the loaded and bypass positions.

7. The switchable load coil case as set forth in claim 6 wherein the locking means comprises a groove defining first and second stopwalls and a ridge between the first and second sidewalls, and at least one detent in the actuator which resiliently deflects to lockingly engage a first side of the ridge so as to position the actuator in the loaded position and a second side of the ridge so as to position the actuator in the bypass position.

8. The switchable load coil case as set forth in claim 2 wherein the contact assembly comprises a seal for forming an air-tight seal with the actuator.

9. The switchable load coil case as set forth in claim 2 wherein the terminal housing comprises a cavity for rotatably receiving the contact assembly between the loaded and bypass positions, wherein the front panel comprises a groove defining first and second stopwalls, wherein the actuator head has a protrusion for cooperatively engaging the groove and for limiting movement of the actuator between the loaded and bypass positions, and wherein engagement between the first stopwall and the protrusion locates the actuator in the bypass position and engagement between the second stopwall and the protrusion locates the actuator in the loaded position.

10. The switchable load coil case as set forth in claim 1 wherein the contact assembly comprises a rotor for receiving four corresponding contacts wherein a first pair of contacts is disposed at a first depth and a second pair of contacts is disposed at a second depth for electrically separating the contacts.

11. A switch assembly for use in a load coil case, the load coil case having a housing for covering a plurality of incoming and outgoing wire pairs, and a load coil associated with each incoming and outgoing wire pair, the switch assembly comprising a front panel, a back panel, and a terminal housing associated with each load coil and having a plurality of contacts for forming an electrical connection to the load coil and incoming and outgoing wire pairs, and an actuator selectively movable between loaded and unloaded positions and having a head and a contact assembly for forming an electrical connection with the terminal contacts, wherein the contact assembly connects the load coil in series with the incoming and outgoing wire pairs when the actuator is in the loaded position and the contact assembly connects the incoming and outgoing wire pairs while bypassing the load coil when the actuator is in the bypass position, and wherein the contact assembly is disposed between the front panel and the back panel and communicates with the head of the actuator through the front panel.

12. The switch assembly as set forth in claim 11 comprising a cavity in the terminal housing for rotatably receiving the actuator and a groove defining first and second stopwalls, wherein the actuator comprises a protrusion for cooperatively engaging the groove and for limiting movement of the actuator between the first and second stopwalls, and wherein engagement between the first stopwall and the protrusion locates the actuator in the bypass position and engagement between the second stopwall and the protrusion locates the actuator in the loaded position.

13. The switch assembly as set forth in claim 12 wherein the actuator comprises a shoulder having an internal notch, and the contact assembly comprises a shaft for engaging the internal notch and for mating the head of the actuator with the contact assembly.

14. The switch assembly as set forth in claim 13 comprising means for rotatably locking the actuator between the loaded and bypass position.

15. The switchable load coil case as set forth in claim 14 wherein the locking means comprises a ridge disposed in the groove between first and second stopwalls, and at least one detent in the actuator which resiliently deflects to lockingly engage a first side of the ridge to position the actuator in the bypass position and a second side of the ridge to position the actuator in the loaded position.

16. The switch assembly as set forth in claim 15 wherein the contact assembly comprises a seal for forming an air-tight seal with the actuator.

17. The switch assembly as set forth in claim 12 wherein the groove further comprises a ridge disposed between first and second stopwalls, and the actuator comprises at least one detent which resiliently deflects to lockingly engage a first side of the ridge so as to position the actuator in the bypass position and a second side of the ridge so as to position the actuator in the loaded position.

18. The switch assembly as set forth in claim 11 wherein the contact assembly comprises a rotor for receiving four corresponding contacts wherein a first pair of contacts is disposed at a first depth and a second pair of contacts is disposed at a second depth for electrically separating the contacts.

19. The switch assembly as set forth in claim 11 wherein the terminal housing comprises a cavity for rotatably receiving the contact assembly, and wherein the front panel comprises a groove defining first and second stopwalls, wherein the actuator head comprises a protrusion for cooperatively engaging the groove and for limiting movement of the actuator between the loaded and bypass positions, and wherein engagement between the first stopwall and the protrusion locates the actuator in the bypass position and engagement between the second stopwall and the protrusion locates the actuator in the loaded position.

* * * * *